United States Patent [19]

Yi

[11] 3,963,221

[45] June 15, 1976

[54] MIXING APPARATUS

[75] Inventor: Chang-Han Yi, Belle Mead, N.J.

[73] Assignee: Union Carbide Corporation, New York, N.Y.

[22] Filed: Feb. 28, 1974

[21] Appl. No.: 446,783

[52] U.S. Cl. ..... 259/180; 23/267 MS; 259/4 AB

[51] Int. Cl.[2] ..... B01F 5/00

[58] Field of Search ..... 259/4, 180, 150, 18, 259/36; 138/42, 43; 48/180 R, 180 B, 185; 23/252 R, 283, 288 G, 267 MS

[56] References Cited

UNITED STATES PATENTS

| | | | |
|---|---|---|---|
| 1,419,216 | 6/1922 | Burckhardt | 259/4 |
| 3,051,453 | 8/1962 | Sluijters | 259/4 |
| 3,195,865 | 7/1965 | Harder | 259/4 |
| 3,239,197 | 3/1966 | Tollar | 259/4 |
| 3,328,003 | 6/1967 | Chisholm | 259/4 |
| 3,620,506 | 11/1971 | So | 259/4 |
| 3,775,063 | 11/1973 | Grout et al. | 48/180 R |

*Primary Examiner*—Robert W. Jenkins
*Assistant Examiner*—James A. Niegowski
*Attorney, Agent, or Firm*—Charles J. Metz

[57] ABSTRACT

A mixing apparatus is disclosed that is particularly suitable for the gravity feed mixing of granular materials. The apparatus comprises a main conduit divided into sub-conduits having substantially constant cross-sectional areas. The sub-conduits mix and re-mix sub-streams of material flowing through the apparatus. The sub-conduits are described by planar surfaces, and the cross-sectional area of the main conduit is substantially constant throughout the length of the apparatus.

4 Claims, 8 Drawing Figures

FIG. 4
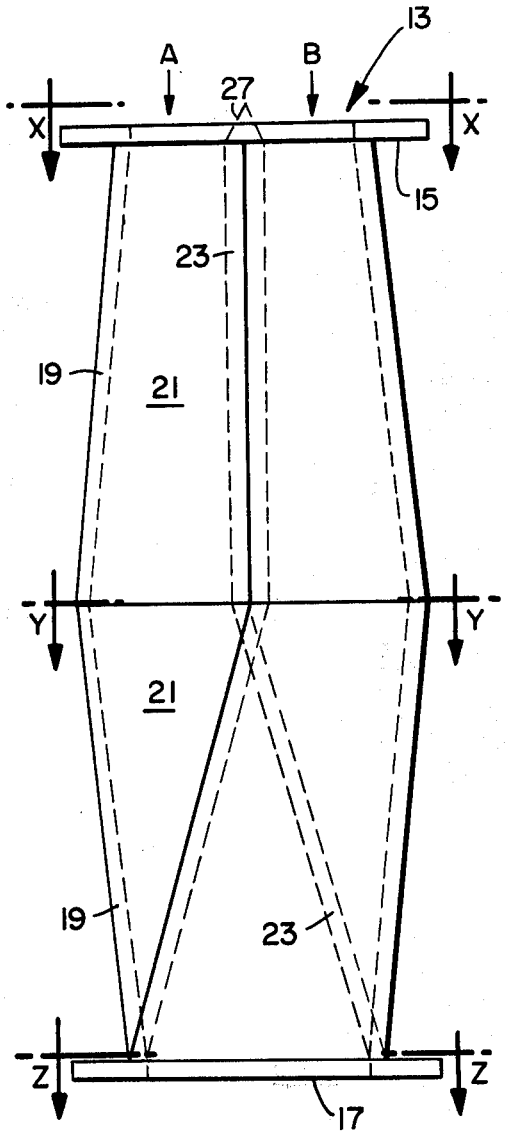
FIG. 5
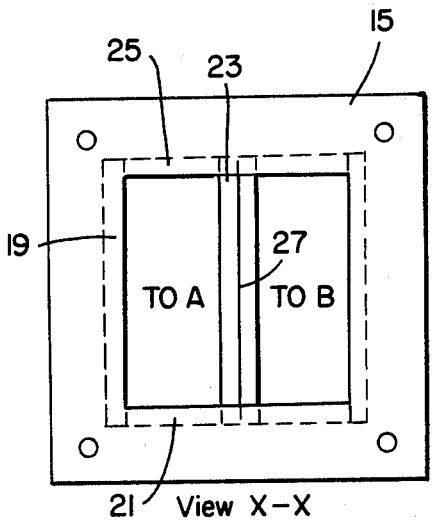
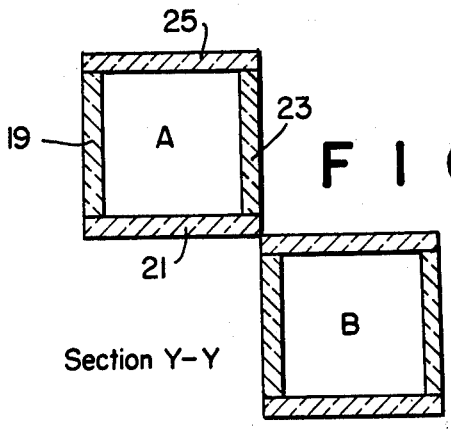
FIG. 6
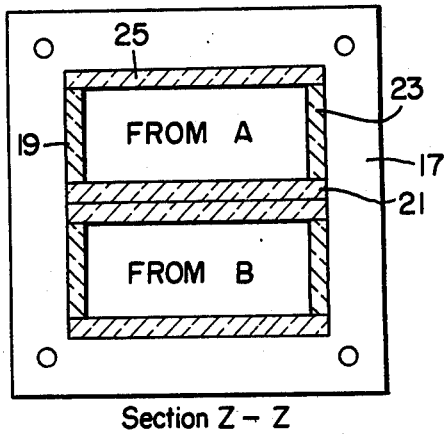
FIG. 7

MIXING APPARATUS

The invention relates to a mixing apparatus that is particularly suitable for the gravity feed mixing of granular materials.

The art has disclosed many types of mixing apparatus wherein a main conduit is divided into subconduits to divide and re-divide a flowing stream into a plurality of partial streams until the desired degree of mixing is achieved. Illustrative of such prior art is Sluijters, U.S. Pat. No. 3,051,453 and Chisholm, U.S. Pat. No. 3,328,003. The apparatus of Sluijters is designed primarily for blending viscous liquid substances, such as viscose or other material that is subsequently forced through a small opening such as a spinnerette to form a continuous fiber. The apparatus of Chisholm is designed primarily for the purpose of producing a stream having different layers, such as a stream of heat plastified thermoplastic resins having layers of different colors, in order ultimately to produce a plastic article such as a thin film or sheet having multi-colored stripes. One characteristic that is common to both Sluijters and Chisholm is that the material flowing through their apparatus is a viscous liquid, and significant pressure must be employed in order to maintain the flow of the stream. While Sluijters does state that his apparatus is also suitable for mixing streams of granular material, the sharp changes in cross-sectional area and in flow direction at the baffles in Sluijters' apparatus would make his apparatus inappropriate for the gravity feed mixing of granular material. The Chisholm apparatus is not said to be useful for mixing granular material at all, let alone by gravity feed of the material to be mixed. Also, the Chisholm apparatus appears to be expensive and complicated to construct because the curved surfaces of the baffles must follow precise algebraic equations in order to maintain the constant cross-sectional area asserted for the channels. For instance, in FIGS. 5 and 6 of Chisholm, the solid curve *a* is said to be generated from the equation $y = (\frac{1}{2})^x$. That such an apparatus would be relatively complicated and expensive to construct is apparent from mere inspection. Further, while the individual channels of the Chisholm apparatus have constant cross-sectional area throughout their length, at the transition between channels, there is a sharp cross-sectional area change of as much as about 12.5 percent.

It is an object of this invention to provide a mixing apparatus especially suitable for the gravity feed mixing of granular material.

It is another object of this invention to provide a mixing apparatus that is relatively easy and inexpensive to construct.

It is a further object of this invention to provide a mixing apparatus that provides for the efficient mixing of granular material.

A still further object of the invention is to provide a mixing apparatus that can be composed entirely of planar surfaces, and is thereby uncomplicated and inexpensive to construct.

One more object of the invention is to provide a mixing apparatus that can be constructed of readily and easily prepared modular units.

Another object is to provide a mixing apparatus that can rapidly and easily be adjusted (by adding or removing modular units) to control the degree of mixing.

These and other objects of the invention are accomplished by the provision of a mixing apparatus comprising a conduit of a predetermined length extending along a main flow path, wherein the cross-sectional area of said conduit is substantially constant at all positions along said main flow path, and wherein said mixing apparatus is composed of a plurality of units of predetermined length disposed adjacently and serially along said main flow path, each unit having an ingress end and an egress end, and each unit being composed of a plurality of sub-conduits, each sub-conduit of each unit having a major axis and a minor axis in cross-section at the ingress end thereof, the major and minor axes being perpendicular to each other at the ingress end, means within each unit to alter each sub-conduit such that the major and minor axes in cross-section are reversed (i.e., each is rotated 90°) at the egress end of each unit, wherein the cross-sectional area of each sub-conduit of each unit is substantially constant throughout the entire length of each unit, wherein each sub-conduit of each unit is described by planar surfaces, and wherein the major and minor axes respectively in cross-section of each sub-conduit at the egress end thereof are reversed (i.e., rotated 90°) with respect to the major and minor axes respectively in cross section of each sub-conduit at the ingress end of the next adjacent unit along said main flow path.

Further objects and advantages of the invention will become apparent from the following specification, taken in connection with the drawings wherein:

FIG. 4 is a side view of a modular unit similar to the one shown in FIG. 2;

FIGS. 5, 6 and 7 are cross-sectional views taken along the lines x—x, y—y and z—z, respectively, of FIG. 4.

The mixer of the invention operates on the principle of constant area affine transformation. Thus, the sub-conduits must meet two requirements — first, they must maintain substantially constant cross-sectional area throughout their length, and second, the geometric shape of the cross-section of each sub-conduit must vary along the length thereof such that each dimension in cross-section is changed by a uniform ratio.

Figure 1:
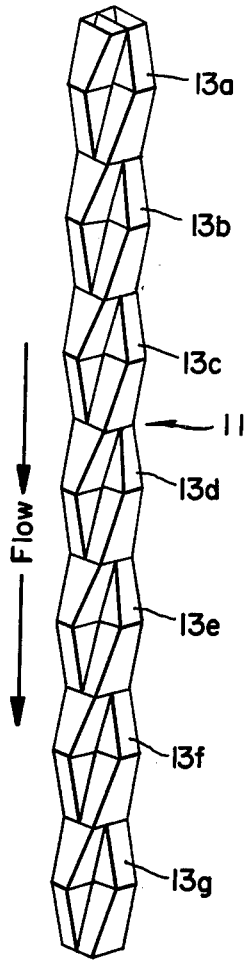
FIG. 1 is a perspective, exterior view of an apparatus embodying the principles of the invention.

In FIG. 1, a mixer, shown generally as 11, embodying the principles of the invention is shown. The mixer 11 is composed of several modular units 13a–13g disposed one on top of the other along the main direction of flow, shown by the arrow in FIG. 1.

Figure 2:
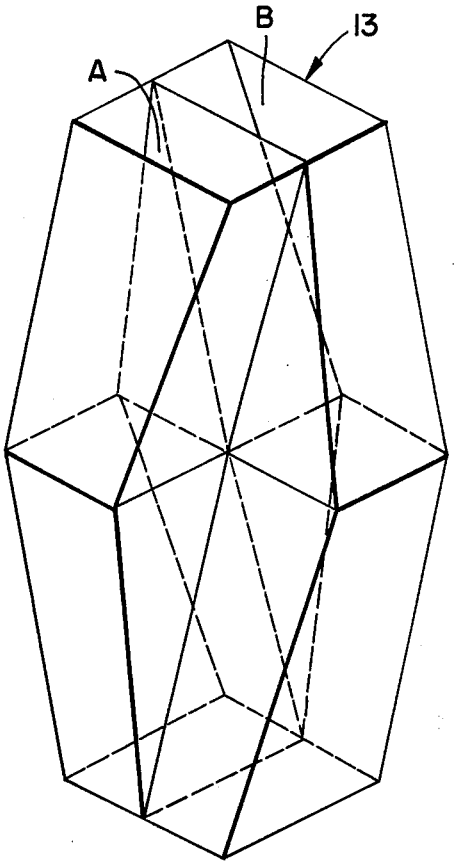
FIG. 2 is a perspective transparent view of one modular unit of the apparatus of FIG. 1.

Modular units 13 are shown in FIGS. 2 and 4, and cross-sections at various positions in the unit 13 of FIG. 4 are shown in FIGS. 5, 6 and 7. The unit 13 is divided into two channels, A and B, each channel A and B having a major axis and a minor axis at the ingress end of the unit 13. The ingress end is shown as section x—x in FIGS. 4 and 5. The channels A and B are shaped such that at the egress end, shown as section z—z in FIGS. 4 and 7, the two channels A and B have major and minor axes that are reversed with respect to the ingress end. In assembling the mixer 11 by stacking modular units 13 one on top of the other, the major and minor axes of the channels at the egress end of one unit will be reversed with respect to the major and minor axes of the channels at the ingress end of the next adjacent unit.

The construction of the modular units 13 is relatively simple and inexpensive. For instance, in the unit 13 shown in the drawings, the cross-section of the entire unit at the ingress end (x—x in FIG. 4) is square, and the cross-section of each of the channels A and B at that point is a rectangle having a major axis twice the length of the minor axis. Midway through the unit 13, at y—y (in FIG. 4) the cross-section of each channel A and B is a square, and at the egress end z—z (in FIG. 4) of the unit 13, the cross-sections of the two channels A and B are rectangles having the same shape they had at the ingress end x—x, except that the major and minor axes are reversed, i.e., rotated 90° in the cross-sectional plane. While, for convenience, ingress and egress ends have been referred to, it will be observed that the modular units can be turned upside down and will still operate in the same way.

In FIGS. 4 through 7, the modular unit 13 is shown having a finite wall thickness. The unit 13 in these FIGS. 4–7 has two flanges, an ingress flange 15 and an egress flange 17, to facilitate the assembling of the units 13 into the assembled mixing apparatus 11. The walls which form the channels A and B are composed of planar surfaces that interconnect the sides of the rectangular opening of each channel at the ingress end (x—x) of each unit 13, to the sides of the square opening at (y—y) mid-way through the unit 13, and from there to the sides of the rectangular opening of each channel at the egress end (z—z) of each unit. To illustrate with channel A, the four sides of channel A are shown as 19, 21, 23 and 25 in FIGS. 4 through 7.

The two flanges 15 and 17 facilitate the assembly of the units 13 into a mixing apparatus 11 having a plurality of modular units 13. The egress flange 17 rests upon the ingress flange 15 of the next adjacent unit 13 along the main flow line. In order to maintain substantially constant total cross-sectional area of the apparatus 11 throughout its entire length, a knife edge 27 extends up through the ingress flange 15 so that it touches the bottom surface of the side dividing the two channels of the unit 13 immediately above it. For instance, the knife edge 27 extending through the ingress flange 15 of FIG. 4 will touch the bottom surface of the wall 21 (FIG. 7) at the egress end z—z of the next adjacent unit 13 prior to it in the flow line. In an alternative construction, the walls of the conduits could extend through the flanges, thereby eliminating the need for a knife edge or similar means.

Figure 3:
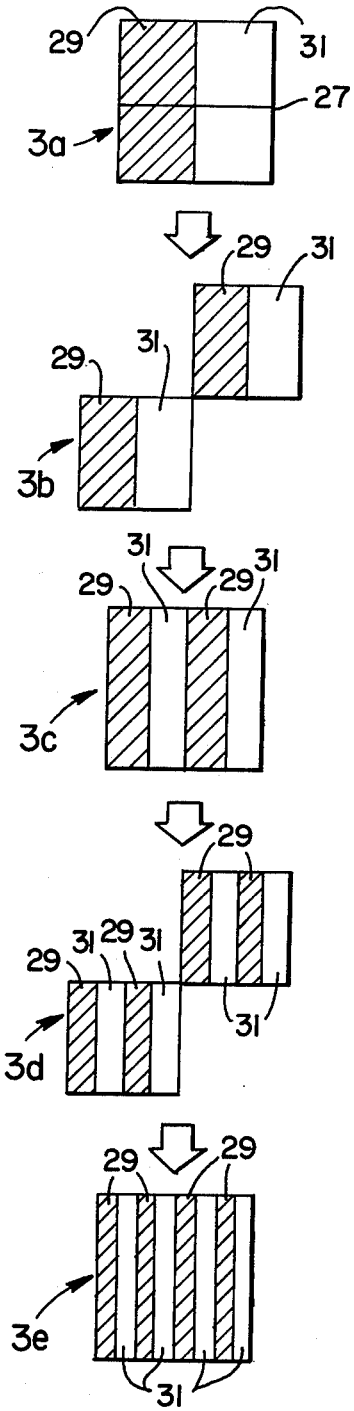
FIG. 3 is a cross-sectional schematic view of two materials being blended at various intervals during their passage through the apparatus of the invention.

In FIG. 3, there is shown schematically the cross-section of two granular materials to be mixed or blended at various stages during their passage through two modular units. At 3*a*, two granular materials 29 and 31 flow into the ingress end of a modular unit. The knife edge 27 divides the two materials 29 and 31 into two channels. At the midpoint of the passage of the two materials 29 and 31 through the first modular unit, the cross-section is as shown at 3*b*. At 3*c*, the cross-section of the two materials 29 and 31 is shown as it emerges from the egress end of the first modular unit. As is seen at this point, the first modular unit has divided a flowing stream consisting of two layers into a four-layer stream. The process continues in the second modular unit which, as shown in 3*d*. and 3*e*., divides a four-layered stream into one having eight layers or stria.

The number of modular units needed to achieve complete mixing of two granular materials can be calculated as follows:

Consider two streams of granular material being fed into a mixer. Let H be the total width of the original stream, and $t$ be the striation layer thickness. Initially H is equal to $t$, assuming no premixing. If the original stream is cut in half and refolded such that the striation layer thickness is divided in half, $t$ will equal H/2. By repeating this process n times, the original striation layer thickness can be reduced to $H/2^n$. Thus, $t = (H/2^n)$. In order to obtain complete mixing, the striation layer thickness should be less than or equal to the scale of examination h, thus $h \geqq t$. The scale of examination cannot be smaller than the pellet diameter d of the granular material to be mixed.

$h$ min. $\sim d$ and $t$ min. $\sim d$

Thus, from the above equations, $$d \sim t \text{ min.} = (H/2^n)$$

Therefore, perfect blending can be achieved if $$d \geqq H/2^n$$

or $$n \ln 2 \geq \ln H/d$$

and finally $$n \geqq (\ln (H/d)/\ln 2)$$

wherein $n$ is the number of units, H is the width of the blending unit, and $d$ is the diameter of the pellets to be mixed.

As an illustration, for a blending unit similar to those shown in the figures, and being 8 inches long and 4 inches by 4 inches in cross-section at the ingress and egress ends thereof, perfect blending of ⅛-inch diameter pellets is achieved with 5 modular units.

Figure 8:
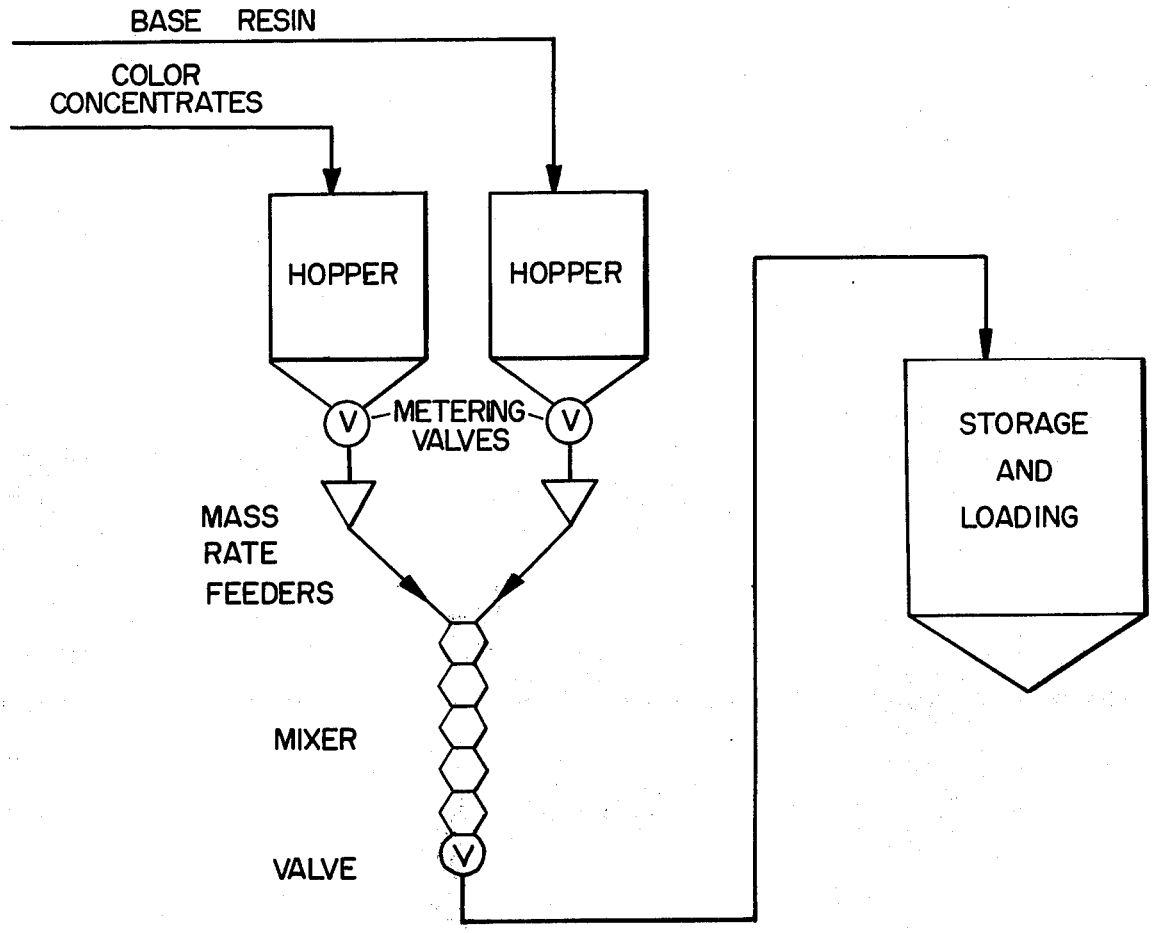
FIG. 8 is a schematic view showing the mixer of the invention employed in a process for blending and storing granular plastic materials.

In FIG. 8, one practical illustration of the use of the mixing apparatus of the invention is shown. In this illustration, pellets of base thermoplastic resin are mixed with pellets of color concentrate resin.

Mathematical analysis of the modular units 13 shown in the Figures herein demonstrate that the cross-sectional areas of the channels A and B vary by not more than about 3 percent throughout their entire length. The maximum variation of 3 percent occurs at the two points mid-way between x—x and y—y, on the one hand, and between y—y and z—z, on the other. The cross-sectional area variation from that at x—x rises smoothly in a parabolic curve as one proceeds along the main flow path to the 3 percent maximum, and then decreases to zero variation again at y—y. The same smooth variation in a parabolic curve occurs between y—y and z—z. The foregoing holds for any two-channel modular unit of the type described herein, regardless of the overall length of the unit.

While the invention has been illustrated by referring to a two-channel mixer, variations can be made without departing from the spirit of the invention. For instance, where it is desired to achieve efficient mixing in less overall vertical distance, modular units having three or more channels can be used. It should be mentioned that the number of channels used in the mixer and the number of materials to be mixed are independent. The described two-channel mixer can be employed to mix three or more materials.

What is claimed is:

1. A mixing apparatus comprising a conduit of a predetermined length extending along a main flow path, wherein the cross-sectional area of said conduit is substantially constant at all positions along said main flow path, and wherein said mixing apparatus is composed of a plurality of units of predetermined length disposed adjacently and serially along said main flow path, each unit having an ingress end and an egress end, and each unit being composed of a plurality of sub-conduits, each sub-conduit of each unit having a major axis and a minor axis in cross-section at the ingress end thereof, means within each unit to alter each sub-conduit such that the major and minor axes in cross-section are reversed at the egress end of each unit, wherein the cross-sectional area of each sub-conduit of each unit is substantially constant throughout the entire length of each unit, wherein each sub-conduit of each unit is described by planar surfaces, and wherein the major and minor axes in cross-section of each sub-conduit at the egress end thereof are reversed with respect to the major and minor axes in cross-section of each sub-conduit at the ingress end of the next adjacent unit along said main flow path, said mixing apparatus being suitable for use in the gravity feed mixing of granular materials.

2. The mixer of claim 1 wherein the cross-section of the conduit at the said ingress and egress ends of said units is square.

3. The mixer of claim 2 wherein the cross-sections of the sub-conduits at the ingress and egress ends of said units are rectangular.

4. The mixer of claim 3 wherein the cross-sections of the sub-conduits at a point midway between the ingress and the egress ends of each unit are square.

* * * * *